US006220479B1

(12) United States Patent
Fishman

(10) Patent No.: US 6,220,479 B1
(45) Date of Patent: Apr. 24, 2001

(54) CONFECTIONERY DISPENSER

(75) Inventor: John D. Fishman, Cranston, RI (US)

(73) Assignee: Toycept, Inc., Cranston, RI (US)

( * ) Notice: Subject to any disclaimer, the term of this patent is extended or adjusted under 35 U.S.C. 154(b) by 0 days.

(21) Appl. No.: 09/390,908

(22) Filed: Sep. 7, 1999

(51) Int. Cl.[7] ..... A24F 15/04
(52) U.S. Cl. ..... 221/24; 221/310
(58) Field of Search ..... 221/260, 232, 221/238, 226, 310, 307, 308, 24, 198, 268

(56) References Cited

U.S. PATENT DOCUMENTS

| | | | | |
|---|---|---|---|---|
| 2,621,655 | * | 12/1952 | Olson | 221/232 |
| 3,854,625 | * | 12/1974 | Kuebler | 221/307 |
| 4,779,759 | * | 10/1988 | Seavey | 221/232 |
| 4,966,305 | | 10/1990 | Hinterreiter . | |
| 5,222,627 | | 6/1993 | Coleman . | |
| 5,385,267 | | 1/1995 | Diamond . | |
| 5,460,295 | | 10/1995 | Law . | |
| 5,531,318 | | 7/1996 | Coleman . | |
| 5,554,077 | | 9/1996 | Coles . | |
| 5,779,095 | | 7/1998 | Diamond . | |
| 5,785,206 | | 7/1998 | Chan . | |

* cited by examiner

*Primary Examiner*—Kenneth W. Noland
(74) *Attorney, Agent, or Firm*—Richard D. Zimmerman

(57) ABSTRACT

A confectionery dispensing device that dispenses gum balls or other confectioneries at a point remote from the user's hand with a popping sound and action. Confectioneries are stored in a container with a spring, gravity, or other biasing means which delivers a plurality of confectioneries to a conduit serially. A plunger ejects the confectioneries one at a time through the conduit so that the confectionery gently pops out of the device. A face or other figure can be placed around the ejecting end of the flexible finger tube, which face can remain permanently open, or open in a door or jaw-like manner upon ejection of the confectionery.

14 Claims, 6 Drawing Sheets

CONFECTIONERY DISPENSER

TECHNICAL FIELD

The technical field of this invention concerns dispensers for gum balls and other confectioneries.

BACKGROUND OF THE INVENTION

Children are amused and entertained by novel confectionery dispensing devices. Consumers of gum balls, hard candy, tablets, mints and other edible confectioneries also find portable hand held dispensing devices convenient for storing, preserving, and dispensing such confectioneries. There are a variety of well-known devices having storage chambers from which a plurality of confectioneries may be removed individually by action of the consumer. Well-known confectionery dispensers place balls or other confectioneries in position for release by biasing the objects with platform and spring systems or gravity to deliver the confectionery to the dispensing end of the storage container.

Other well-known devices hold confectioneries in dispensing devices that are decorated with, or otherwise integrated with, human-like or creature-like faces to entertain children. Some of these devices entertain by dispensing gum balls in gravity-fed spiral or other shaped tracks which the child can view through transparent enclosures.

Known confectionery dispensing devices, however, do not permit the ejection with a "popping" sound and action of the gum ball or other confectionery at a point remote from the consumer's hand which operates the dispensing device. Children are interested, amused and entertained by the popping sound and action as confectioneries are ejected from the present invention.

SUMMARY

The present invention is directed to a confectionery dispensing device that allows the user to dispense gum balls and other confectioneries from the device at a point remote from the user's hand. The "popping" sound and action is surprising, amusing and entertaining to the user. Confectioneries are stored in a container with a spring or gravity, or other biasing means which permits a plurality of confectioneries to be delivered to a conduit serially. A hand operated plunger ejects the confectionery through flexible fingers when operated by the user. The flexible fingers are sized to retain the confectionery in the conduit until the plunger is operated. The plunger forces the confectioneries one at a time through the flexible fingers so that the confectionery gently pops out of the device into the user's other hand, but not with so great a force that the gum ball become a dangerous projectile. A face or other figure can be placed around the ejecting end of the flexible fingers tube, which face can remain permanently open or open in a door or jaw-like manner upon ejection of the confectionery.

BRIEF DESCRIPTION OF THE DRAWINGS

These and other features, aspects and advantages of the present invention will become better understood with regard to the following descriptions and its drawings where.

DETAILED DESCRIPTION OF THE DISCLOSURE

Figure 1:
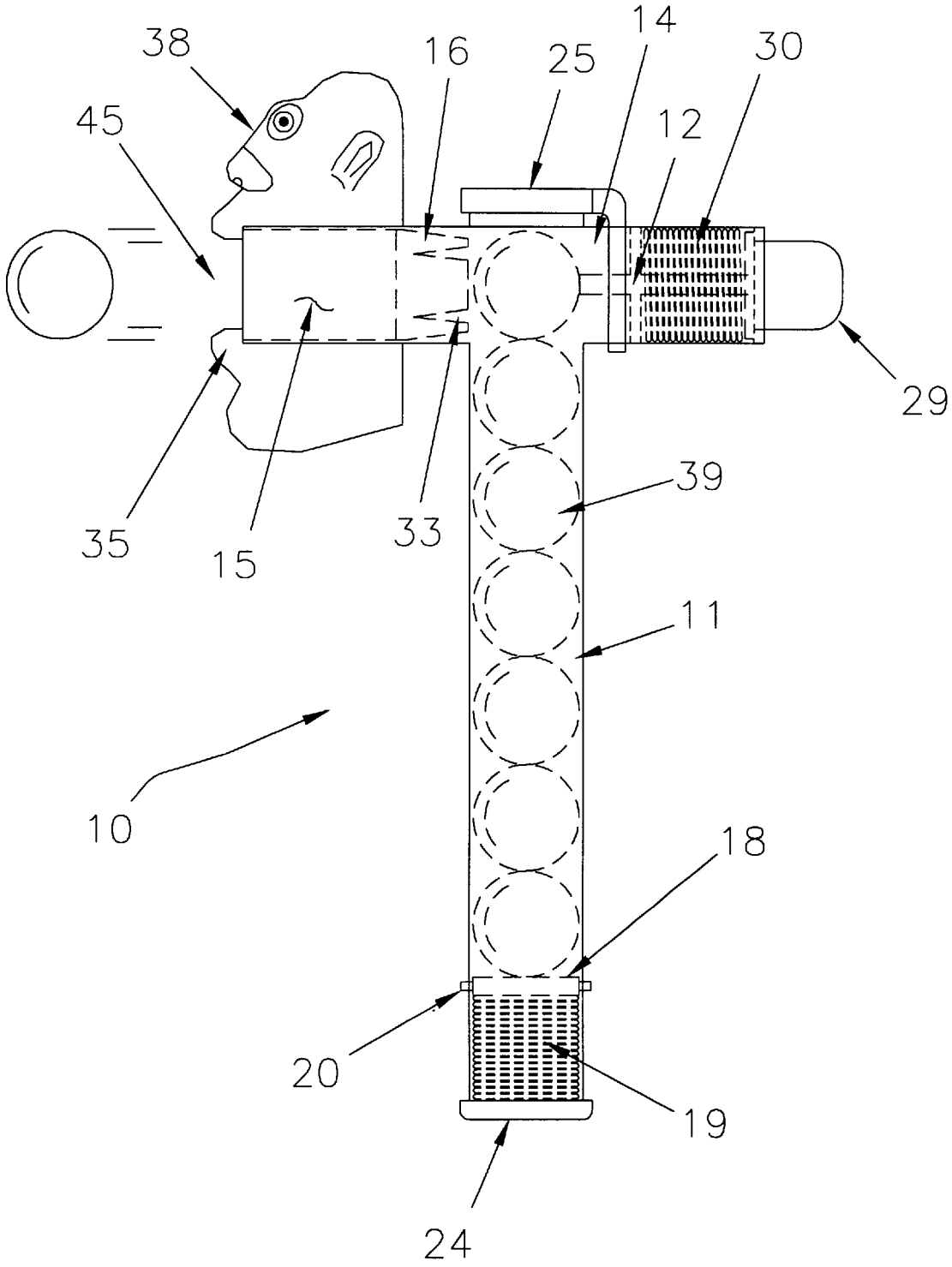
FIG. 1 shows a perspective view of the confectionery dispenser.
Figure 2:
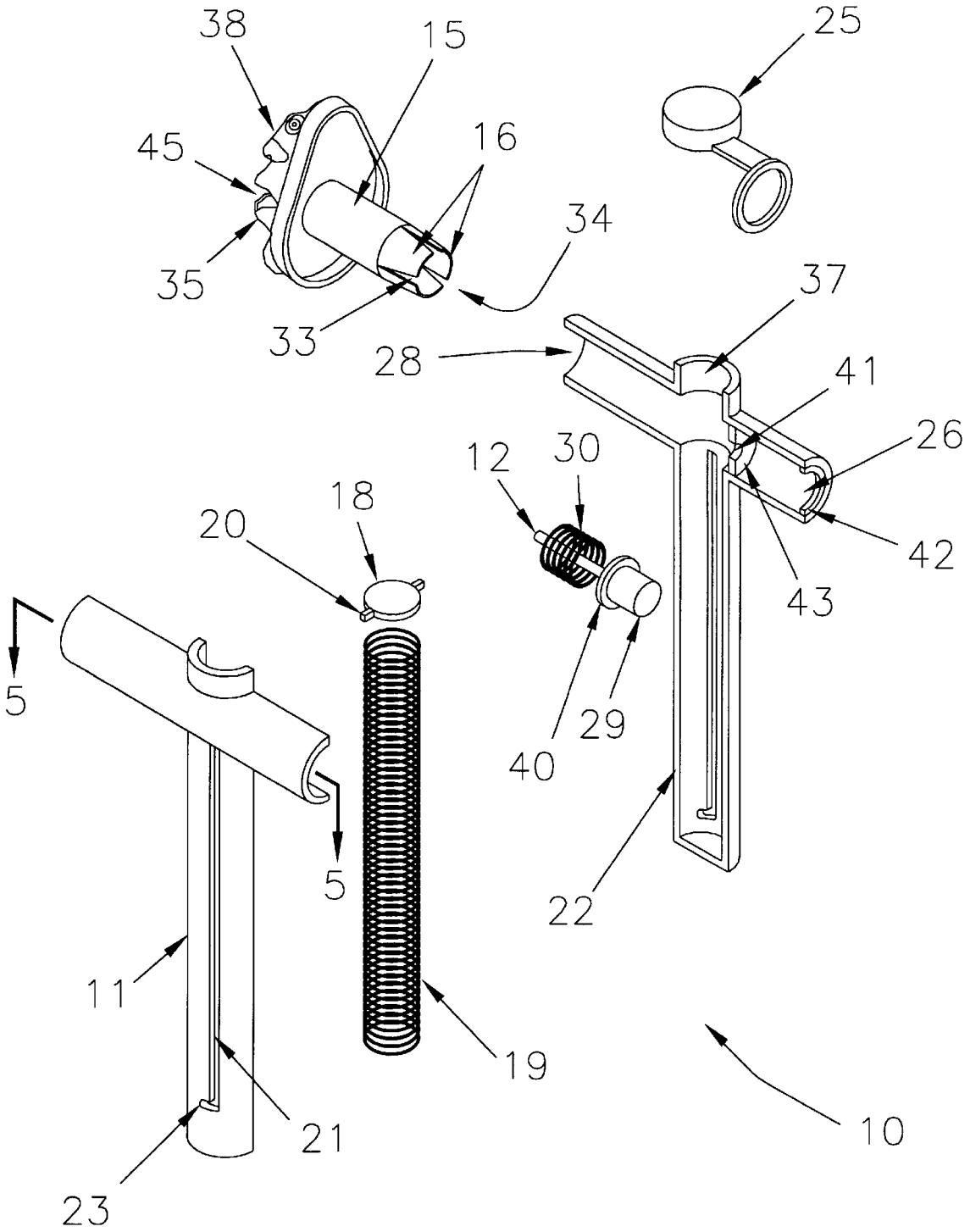
FIG. 2 shows an exploded view of the confectionery dispenser.

Referring to FIGS. 1 & 2, the confectionery dispenser 10 has a confectionery storage container 11, a plunger 12, a plunger actuating means, a conduit 14 and a flexible fingers tube 15 having flexible fingers 16 at one opposing end and an ejecting opening 17 at the other opposing end.

As shown in FIG. 2, the storage container (11) may have a platform 18, activated by a platform spring 19, to serially present the confectioneries by biasing them against the conduit (14). A tab 20 may project from the platform and be movably mounted on or through the container to permit the user to retract the platform when loading the container, and to stabilize the platform in the cylinder. The tab in this embodiment in FIG. 2 passes through a platform channel 21 in the wall 22 of the storage container to movably connect the platform to the storage container, and the platform channel has a locking slot 23 to hold the tab and platform at the bottom 24 of the storage container to permit easier container loading.

Figure 3:
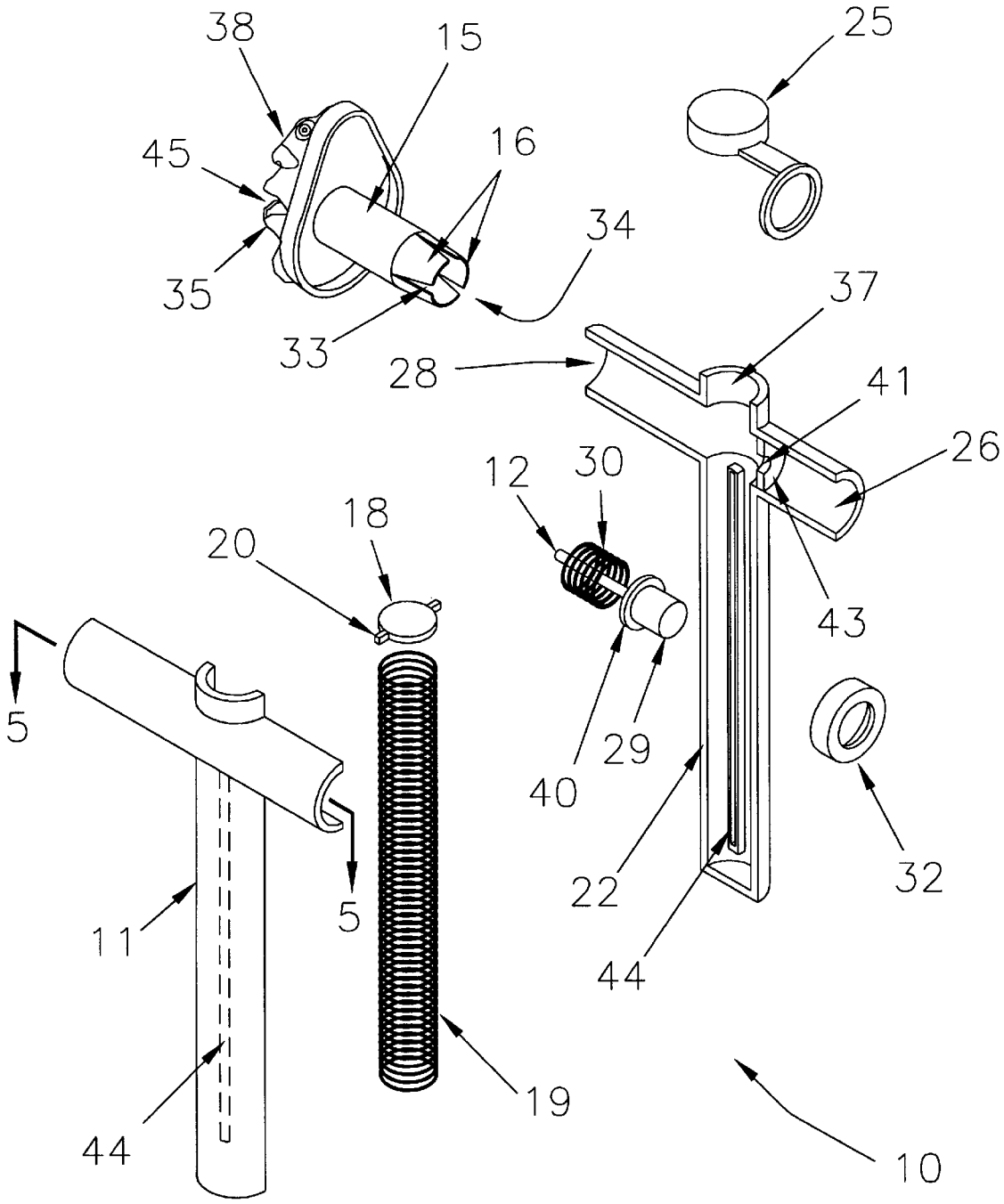
FIG. 3 shows an exploded view of an alternative embodiment of the confectionery dispenser.

As shown in FIG. 3, an alternative confectionery dispenser can be constructed in which the platform tab (20) slides in a platform channel 44 inside the storage container, where the platform channel does not go all the way through the wall (22). In both alternatives, the tabs are stopped to prevent the platform from entering the conduit when the last confectionery is dispensed.

The confectionery storage container (11) in this embodiment is cylindrical, and made of a plastic material, and could be transparent or translucent to enhance the visual effect of the device. This is especially beneficial when multicolored confectioneries are used. Wood, metal or a variety of other materials could be used, but likely would be prohibitively expensive for a mass-produced toy. The storage container could be of numerous shapes on its exterior, such as an ergonomic hand grip or design. The interior of the confectionery storage container should be shaped to permit the confectionaries to travel through the storage container (11) and the conduit (14), such as circular for spherical confectioneries, and square for cube shaped confectioneries.

Figure 4:
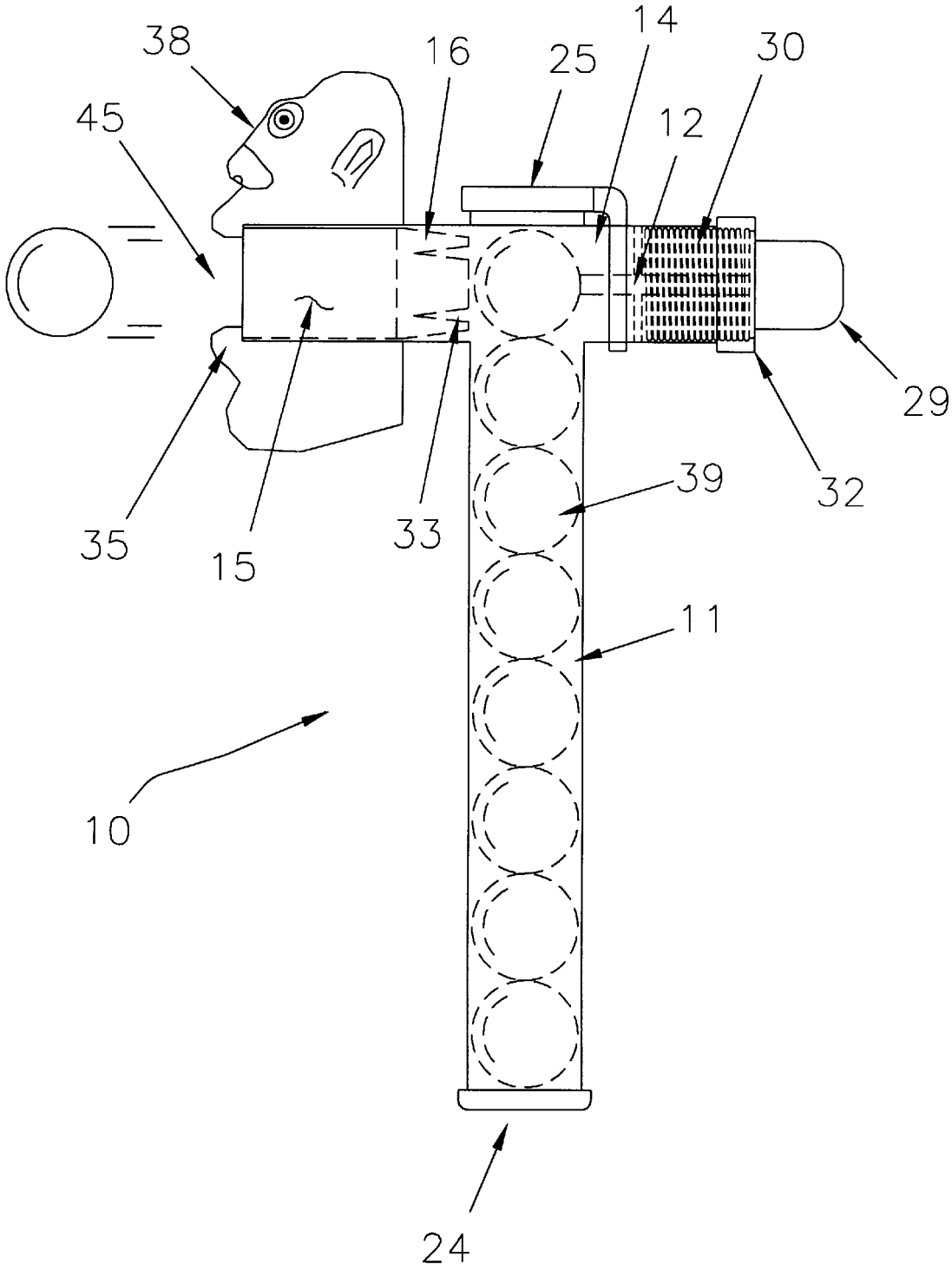
FIG. 4 shows a perspective view of the gravity fed confectionery dispenser.

An equivalent embodiment is shown in FIG. 4, in which the confectioneries are gravity fed by inverting the storage container (11). The platform, spring, tab, platform channel, platform track and locking slot are not needed in this alternative embodiment.

As shown in FIG. 2 & 3, the confectionery storage container (11) can be filled through a removable cap 25 covering the filling opening 37. The cap preferably is located on the conduit, but could be located at any site on the dispenser in communication with the storage container, provided that the storage container can be filled without interference with the loading of the confectioneries. Such interference could arise from the platform (18) and spring

(19) if the filling opening (37) is located too close to the container bottom (24). The cap (25) alternatively can be located on the storage container bottom end (24) in gravity-fed alternatives, and in other embodiments if the spring and platform are removable. The filling opening is then located at the storage container bottom end.

The cap is removed and confectioneries travel through the filling opening (37) in the conduit and into the storage container. Alternatively, the confectionery storage container could be removably attached by threads or friction to the conduit (14), which would permit removal of the confectionery storage container for filling with confectioneries. These alternative filling methods also permit refilling of the storage container after all gum balls are dispensed. Filling may be facilitated by the flexible sleeves or wrappers in which gum balls or confectioneries are commonly sold. The wrappers hold the confectioneries while the consumer loads them into the storage container.

Figure 5:
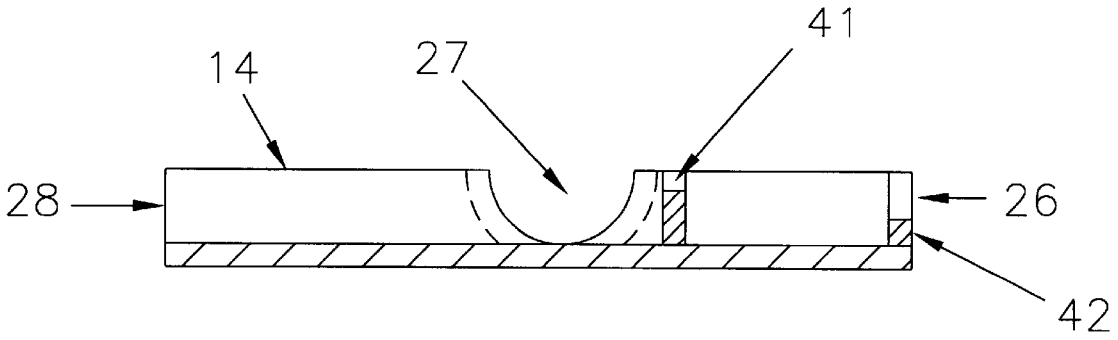
FIG. 5 shows a cross-sectional view of the conduit along the 5—5 axis in FIG. 2.

As shown in FIGS. 2, 3 & 5, the conduit (14) has a plunger opening 26, a confectionery loading opening 27, and a flexible fingers opening 28. The flexible fingers tube (15) is located to receive confectioneries from the conduit ejecting opening. In the preferred embodiment, the conduit and container are molded together. The plunger (12) is sized to fit the conduit (14). Confectioneries are forced through the confectionery loading opening (27) by the platform (18) or gravity. The user then actuates a plunger button 29 or otherwise actuates the plunger (12), thereby forcing the confectionery through the conduit ejecting opening (28) and into and through the flexible fingers (16). The flexible fingers (16) then force the confectionery through the flexible fingers tube (15), and out the ejecting opening (17).

As shown in FIG. 2, the plunger actuating means includes a button 29, a spring 30, a plunger button retainer 40, a plunger button retainer stop 42, and a plunger stop plate 43. The plunger (12) is biased away from the flexible fingers tube (15) by a plunger spring 30 which is contained between the plunger button retainer 40 and the plunger stop plate 43. The plunger stop plate has a plunger guide hole 41 to guide the plunger in making contact with the confectionery.

The plunger button (29) could be a variety of shapes to increase the interest of the user and provide a larger surface area than the plunger 12 which pushes the confectionery and is small enough to fit inside the conduit (14). The plunger button (29) also may serve as a retainer for the plunger spring (19), but numerous well-known alternatives such as clips, pens, shoulders or similar retainers would be equally suitable.

As shown in FIG. 2, the plunger may be trapped between halves of the conduit to movably connect the plunger to the conduit, by means of a plunger button retainer stop 42, or as shown in FIG. 3 can be retained with a retainer ring 32 or a variety of other well-known methods.

Numerous alternative well-known methods could serve as a plunger actuating means to push the confectioneries through the conduit and flexible fingers. The handle could be manually pulled away from the flexible fingers tube, but this method requires more user effort and likely would be less appealing to the user.

Figure 6:
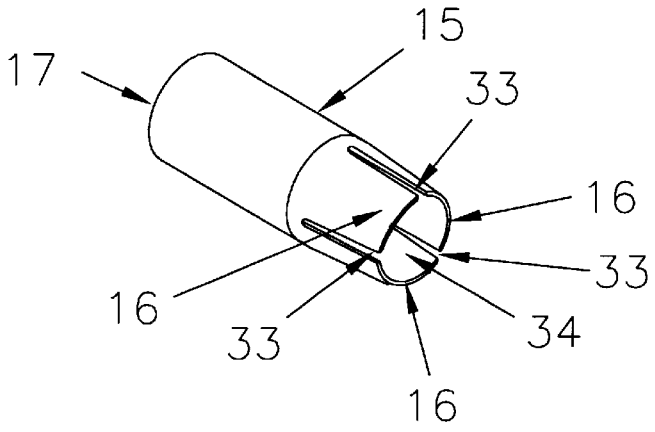
FIG. 6 shows a perspective view of the flexible fingers tube with flexible fingers.

As shown in FIG. 6, the flexible fingers tube (15) has a receiving opening 34 formed by the flexible fingers (16), and an ejecting opening (17) at the opposing end. The flexible fingers tube is sized so the flexible fingers fit within the conduit (14). The flexible fingers have a plurality of slits 33 to permit the flexible fingers to flex outward when the plunger (12) forces a confectionery 39 through the flexible fingers.

Figure 7:
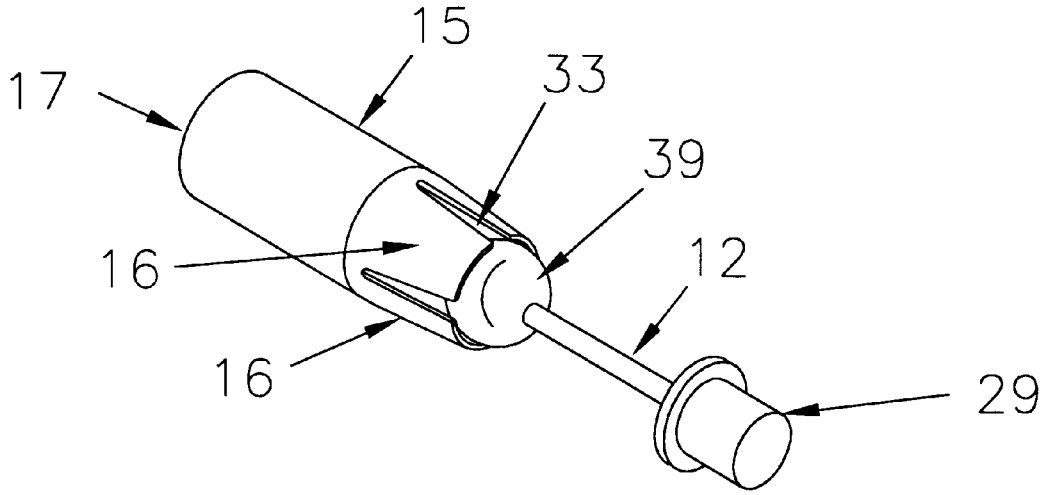
FIG. 7 shows a perspective view of the flexible fingers tube with a gum ball flexing the fingers.
Figure 8:
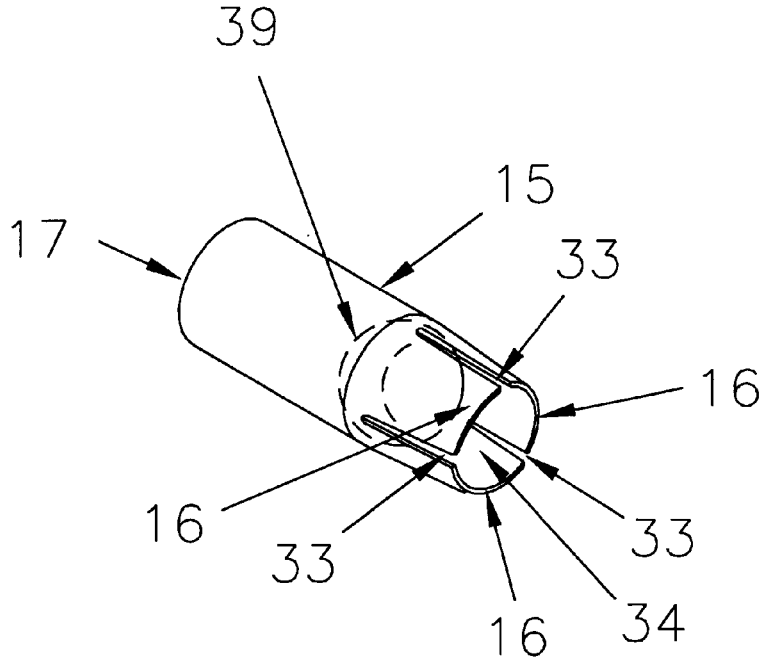
FIG. 8 shows a perspective view of the flexible fingers tube with a gum ball being pushed through the flexible fingers tube.

As shown in FIGS. 7 & 8, as the plunger pushes the confectionery (39) further through the flexible fingers, the relatively elastic fingers press back to their unexpanded shape, thereby exerting a force on the confectionery and forcing it out of the ejecting opening (17) so that the confectionery pops out. The flexible finger slits (33) preferably are rounded at the end away from the receiving opening to reduce material stress, breaking and cracking to the flexible fingers tube.

Most currently manufactured standard size gum balls range from 17/32 to 1¼ inches in diameter. The ⅝ inch gum ball is the most popular size of the smaller gum balls. The process used in manufacturing gum balls is not precise, and "⅝" inch gum balls average approximately 0.600 inches in diameter, and may range between approximately 0.57 and 0.625 inches in diameter. Moreover, "⅝" gum balls are not perfectly spherically, and may vary 0.020 inches or more in their smaller and larger diameters on the same gum ball. For a "⅝" inch gum ball, and ABS flexible fingers, an inside diameter of the flexible fingers receiving opening (34) of approximately 5 to 10% smaller than the average size of the gum ball, and a flexible flange thickness of 0.040 inches works well. A flexible fingers receiving opening inside diameter of approximately 0.55 inches for ⅝" gum balls is used in this embodiment.

The flexible fingers receiving opening should not be so small that it crushes the gum ball, destroying its panned coating. Additionally, too much resistance in the flexible fingers may require too much force on the bottom to dispense the confectionery, and may cause the gum ball to pop out of the tube with too much force, where the gum ball would be considered a "projectile" and possibly be a safety concern. If the receiving opening is too large, the smaller gum balls will not "pop" out of the dispenser. Some gum balls may not pop out as efficiently as others since there is such a range of sizes, but the embodiment specified offers the best known solution given the range of sizes of gum balls.

As shown in FIG. 6, the flexible fingers are tapered so that the thickness of the flexible fingers material is less at the receiving opening (34). The angle of taper on the flexible fingers should be approximately 8 to 12 degrees off of the widest part of the flexible fingers, with approximately 10 degrees used in this embodiment. This angle leaves enough space between the fingers and the top of the housing to permit the fingers to flex properly. More of an acute angle may offer too much resistance to push the confectionery through. Decreasing the angle provides less room for the fingers to flex because they become obstructed by contacting the conduit. Approximately 10 degrees offers adequate resistance, yet makes it possible to pop the gum ball out with an appropriate amount of push on the button.

In this embodiment, the flexible fingers (16) are made of ABS or high impact styrene plastic with sufficient elasticity to expand as the confectionery is forced through the fingers, and sufficient strength to withstand numerous dispensings without breaking. Other plastics such as delrin, polypropylene and ethylene and similar materials could be used. If the same materials are used for the conduit (14) and the flexible fingers (16) and flexible fingers tube (15), as well as the platform (18), the plunger (12), the plunger button (29) and the plunger button retainer (40), they all can be molded in the same mold. Stainless steel or other flexible metal could be used but likely is prohibitively expensive for most hand-held and non-commercial applications.

The conduit (14) should be sized to fit around the flexible fingers so that the fingers have sufficient room to flex.

Similarly, the plunger (12) is designed to fit within the conduit, but should not be permitted to enter the flexible fingers in such a way as to impair the force of the flexible fingers on the gum ball. As shown in FIG. 2, the plunger stop plate 43 stops the plunger from entering the flexible fingers tube. Numerous alternative equivalents are possible.

After the plunger pushes the confectionery into the flexible fingers tube, and the plunger is withdrawn, the next advancing gum ball will then load into the conduit. The gum ball must load in a manner so that it does not obstruct the return movement of the plunger.

The material used for the flexible fingers tube (15), like the flexible fingers, needs to have strong physical properties, yet be flexible when molded in a thickness that is minimal to produce the flexing characteristic that is necessary for the fingers to push the confectionery. Although a material such as delrin, polypropylene, or ethylene all have good characteristics for flexing when molded in a thin formation, as is generally needed for the flexible fingers, it is found that ABS or high impact styrene work just as well. Cost considerations generally would dictate choice of materials within these types of flexible materials.

The flexible fingers tube ejecting opening (17) must be of sufficient size so the gum ball travels through it easily and into the user's hand or other "catcher." Too small an ejecting opening (17) would cause friction and slow down the velocity of the gum ball or even obstruct it, preventing it from exiting from the opening. It is found that the diameter of the opening should be within a range of approximately 8 to 12% larger than the average size gum ball or confectionery for which the device is designed. In one embodiment, the opening is approximately 0.66 inches, which is 10% larger than the average size "⅝" inch gum ball.

The conduit (14) or flexible fingers tube (15) can be decorated with faces 38, other figures or with faces having jaws (35) which open with the plunger to eject the confection through the mouth of the face. The confectionery can eject through the jaws opening 45, as shown in FIG. 1. A variety of other faces, figures, designs, and features can be added to the housing to make it more interesting and attractive to children.

I claim:

1. A confectionery dispenser comprising:

a confectionery storage container having one or more platform channels, a bottom wall, and an opening;

a conduit having a plunger means opening, a confectionery loading opening and a flexible finger opening, the confectionery loading opening being in communication with the confectionery storage container through the opening of the confectionery storage container;

a spring with opposing ends, and a platform with one or more platform tabs, the spring and platform positioned in the confectionery storage container so that each of the platform tabs is movably retained in one of the platform channels, the spring having one opposing end against the bottom wall and the other opposing end against the platform, so that the spring and platform bias confectioneries in the confectionery storage container away from the bottom wall, out of the opening and into the conduit;

a plunger means movably located in the plunger means opening; and a flexible fingers tube having a receiving opening and an opposing ejecting opening, two or more flexible fingers formed to create the receiving opening, the flexible fingers being separated by slits, and the flexible finger tube being in communication with the conduit at the flexible finger opening; the flexible fingers being made of flexible material so that when a confectionery is pushed into the conduit, and the plunger means is operated so that the plunger forces the confectionery into the flexible fingers, the flexible fingers expand until the confectionery passes a tangent of the confectionery, the flexible fingers contract, propelling the confectionery out of the ejecting opening with a popping sound.

2. The confectionery dispenser of claim 1 in which the confectionery storage container has a filling opening.

3. The confectionery dispenser of claim 1 in which the conduit has a filling opening.

4. The confectionery dispenser of claim 1 in which the plunger means is biased away from the flexible fingers by a spring.

5. The confectionery dispenser of claim 4 in which the plunger means has a button, and is movably connected to the conduit and retained in the conduit by a plunger button retainer stop.

6. The confectionery dispenser of claim 4 in which the plunger means is movably connected to the conduit and retained in the conduit by a retainer ring.

7. A confectionery dispenser comprising:

a confectionery storage container having a bottom wall and an opening;

a conduit having a plunger means opening, a confectionery loading opening and a flexible finger opening, the confectionery loading opening being in communication with the confectionery storage container through the loading opening;

a loading means for biasing the confectioneries out of the storage container and into the conduit;

a plunger means movably located in the plunger means opening; and a flexible fingers tube having a receiving opening and an opposing ejecting opening, two or more flexible fingers formed to create the receiving opening, the flexible fingers being separated by slits, and the flexible fingers tube being in communication with the conduit at the flexible fingers opening; the flexible fingers being made of flexible material so that when a confectionery is pushed into the conduit, and the plunger means is operated, forcing the confectionery into the flexible fingers, the flexible fingers expand until the confectionery passes a tangent of the confectionery, the flexible fingers contract, propelling the confectionery out of the ejecting opening with a popping sound.

8. The confectionery dispenser of claim 7 in which the loading means comprises a spring with opposing ends and a platform with one or more platform tabs, the spring and platform positioned in the confectionery storage container so that each of the platform tabs is movably retained in one of the platform channels, the spring having one opposing end against the bottom wall and the other opposing end against the platform, so that the spring and platform bias confectioneries in the confectionery storage container away from the bottom wall, out of the opening and into the conduit.

9. A confectionery dispenser comprising: a confectionery storage container connected to a flexible finger tube having two or more flexible fingers and an ejecting opening; and a means of forcing a confectionery from the confectionery storage container through the flexible fingers, in which the flexible fingers tube has a receiving opening and an opposing ejecting opening, a plurality of flexible fingers formed to create the receiving opening, the flexible fingers being separated by slits, and the flexible fingers tubes being in communication with the conduit at the flexible fingers opening; the flexible fingers being made of flexible material so that when a confectionery is pushed into the conduit, and the means of forcing is operated, it forces the confectionery into the flexible fingers, the flexible fingers expand until the confectionery passes a tangent of the confectionery, the flexible fingers contract, propelling the confectionery out of the ejecting opening with a popping sound.

10. The confectionery dispenser of claim 9 in which the confectionery storage container and flexible fingers tube are connected by a conduit.

11. The confectionery dispenser of claim 9 in which the means of forcing the confectionery through the flexible fingers is a plunger means.

12. The confectionery dispenser of claim 11 in which the plunger means is biased away from the flexible fingers by a spring.

13. The confectionery dispenser of claim 11 in which the plunger means has a button, and is movably connected to the conduit and retained in the conduit by a plunger button retainer stop.

14. The confectionery dispenser of claim 11 in which the plunger means is movably connected to the conduit and retained in the conduit by a retainer ring.

* * * * *